US010410550B2

(12) United States Patent
Myung

(10) Patent No.: US 10,410,550 B2
(45) Date of Patent: Sep. 10, 2019

(54) LOCAL LIGHT-EMITTING ROAD SIGN BOARD APPARATUS

(71) Applicants: HGM CO., LTD., Seoul (KR); Beom-Young Myung, Incheon (KR)

(72) Inventor: Beom-Young Myung, Incheon (KR)

(73) Assignees: HGM CO., LTD., Seoul (KR); BEOM-YOUNG MYUNG, Incheon (KR)

( * ) Notice: Subject to any disclaimer, the term of this patent is extended or adjusted under 35 U.S.C. 154(b) by 48 days.

(21) Appl. No.: 15/546,688

(22) PCT Filed: Feb. 1, 2016

(86) PCT No.: PCT/KR2016/001081
§ 371 (c)(1),
(2) Date: Jul. 27, 2017

(87) PCT Pub. No.: WO2016/126065
PCT Pub. Date: Aug. 11, 2016

(65) Prior Publication Data

US 2018/0033347 A1 Feb. 1, 2018

(30) Foreign Application Priority Data

Feb. 2, 2015 (KR) ..... 10-2015-0016051

(51) Int. Cl.
*G09F 13/18* (2006.01)
*E01F 9/00* (2016.01)
(Continued)

(52) U.S. Cl.
CPC ..... *G09F 13/18* (2013.01); *E01F 9/00* (2013.01); *G09F 7/08* (2013.01); *G09F 13/16* (2013.01);
(Continued)

(58) Field of Classification Search
CPC ..... G09F 2013/1845
(Continued)

(56) References Cited

U.S. PATENT DOCUMENTS 8,844,179 B2 * 9/2014 Pendlebury ..... G09F 13/22 40/544
2008/0155869 A1 * 7/2008 Golle ..... G09F 13/22 40/544
(Continued)

FOREIGN PATENT DOCUMENTS

KR 20-1994-0001406 Y1 3/1994
KR 10-2009-0102274 A 9/2009
(Continued)

*Primary Examiner* — Kristina N Junge
(74) *Attorney, Agent, or Firm* — Roberts Mlotkowski Safran Cole & Calderon, P.C.

(57) ABSTRACT

A local light-emitting road sign board apparatus is disclosed. Local light-emitting panels, displaying road guides in the form of a character, numeral, symbol, or figure, are independently inserted and installed in openings for road sign units that are provided in a main substrate. A sub substrate and a retroreflective sheet are laminated and bonded on each local light-emitting panel so as to form a road sign unit. A retroreflective sheet is also bonded on the main substrate so as to form the background of a road sign unit. When one of road sign units fails, it is possible to simply separate, repair or replace, and reinstall only the failed road sign unit while leaving the others intact.

18 Claims, 12 Drawing Sheets

(51) Int. Cl.

| | |
|---|---|
| ***G09F 13/22*** | (2006.01) |
| ***G09F 13/16*** | (2006.01) |
| ***G09F 7/08*** | (2006.01) |
| *G09F 7/18* | (2006.01) |

(52) U.S. Cl.
CPC ..... *G09F 13/22* (2013.01); *G09F 2007/1804* (2013.01); *G09F 2007/1878* (2013.01); *G09F 2013/1872* (2013.01)

(58) Field of Classification Search
USPC ..... 40/575, 578
See application file for complete search history.

(56) References Cited

U.S. PATENT DOCUMENTS

2013/0255116 A1* 10/2013 Kaoh ..... G09F 27/005 40/563
2015/0279251 A1* 10/2015 Matyear ..... H02S 40/38 362/183

FOREIGN PATENT DOCUMENTS

KR 10-1032516 B1 5/2011
KR 20-2012-0001252 U 2/2012
KR 20120001252 U * 2/2012 ..... G09F 13/0409
KR 10-2013-0023845 A 3/2013

* cited by examiner

LOCAL LIGHT-EMITTING ROAD SIGN BOARD APPARATUS

CROSS-REFERENCE TO RELATED APPLICATIONS

The present application is a U.S. National Phase of PCT/KR2016/001081 filed on Feb. 1, 2016 claiming priority to Korean Patent application No. 10-2015-0016051 filed Feb. 2, 2015. The disclosure of the PCT Application is hereby incorporated by reference into the present Application.

AREA OF TECHNOLOGY

The invention relates to a road sign to be installed for guiding roads, and more specifically to a local light-emitting road sign board apparatus, in which the road sign board only is lighted locally.

BACKGROUND OF INVENTION

In general, road signs are installed in order to provide pedestrians and drivers with road information and traffic guides. The road signs may be divided into types of non-illuminating and illuminating. The non-illuminating types emit light by reflecting light from headlights of the vehicles, but do not have any self light-emitting sources. Contrastingly, the illuminating types of road signs may be divided again to an externally-illuminating type, in which illuminating devices are installed at an outer top portion of the road sign or on the land illuminate the road signs, and an internally-illuminating type, in which the road signs are illuminated by the light output of illuminating devices installed in the road signs. Its visibility of the illuminating types is much more excellent than that of the non-illuminating types. It is known that the illuminating type road signs are about 1.6 times more excellent than the non-illuminating type road signs at night visibility. Since such an excellent visibility raises driving safety and lowers the chance of traffic accidents much, the illuminating type road signs are being introduced more and more widely.

As an example of an internally-illuminating road sign board apparatus has been proposed and patented by Un hoe Baek as "Road Signs" (Korean Patent No. 10-0998741) as shown in FIGS. 1 and 2. According to the road sign board 1 disclosed by Un hoe Baek, more than one light-emitting boards 20 are fixed and installed on a top surface of a base board 10, and the light-emitting boards 20 are installed as sandwiched between the base board 10 and the top board 30 by covering the top surface of the light-emitting boards 20 with a transparent top board 30. Also, a packing member 31 is inserted at the edge portions of the base board 10 and the top board 30. The packing member 31 fills up the gap with a thickness of the light-emitting board 20 between the base board 10 and the top board 30. They seem to keep dust or moisture from entering from outside. Also, according to Un hoe Baek, a first sign portion 40 and a second sign portion 41 containing road information such as direction or destination are formed on at least one position of the light-emitting board 20 or the top board 30 by a method such as etching, coating, printing or painting. The light-emitting board 20 includes the light guide plate 21 and a plurality of LEDs 22 installed on a side surface of the light guide plate 21. Especially, the first sign portion 40 is provided with a roughened surface of light guide plate so as to scatter light, and the light scattering is made to take place all over the surface of the light guide plate 21, but every portion except for the first sign portion 40 are covered by sheet or painting, so that the uncovered portion emits light.

Since the light-emitting board 20 is a component that operates the LED to emit light, it may have a limited life expectancy and sometimes may be broken. And, with the road sign board 1 of Un hoe Baek, even though a single sign portion of many sign portions is broken, the entire road sign board 1 must be replaced with a new one or repaired. More specifically, in order to repair or replace the broken light-emitting board 20, the packing member 310 installed to fill up the gap between the base board 10 and the top board 30 is removed, and then the top board 30 must be detached from the base board 10, for accessing the broken light-emitting board 20. Since the size of the top board 30 is very large and heavy in weight and may be blown by wind, it is going to be very dangerous to repair or replace the light-emitting board 20 while dangling the top board 30 disassembled from the base board 10 in the air. If it falls down on the road, it may cause a serious traffic accident. Therefore, in order to repair the road sign board 1 of Un hoe Baek, a series of works must be performed, which includes (i) removing the packing member 310 and detaching the top board 30 from the base board 10, (ii) putting down the disassembled top board 30 on the ground off the road, (iii) repairing or replacing the broken light-emitting board 20, (iv) picking up the top board 30 and assembling it with the base board 10 and inserting and installing the packing member 310.

For the above works, a sufficient number of workers and heavy equipments need to be used. The maintenance and repairing works may be very inconvenient, ineffective, and time-consuming. The associated cost increases. Furthermore, it is another big problem that the road sign board 1 stops working as a road sign while the top board 30 was removed.

Un hoe Baek's road sign board 1 emits light only on the light-emitting board 20, not the entire surface, providing an effect of saving electric energy. However, since when the light-emitting board 20 emits light the entire surface of the light guide plate 21 scatters the light generated by the LED, the light efficiency could be improved further. The surface of the light-emitting board 20 includes portions for representing letters, numbers, or symbols for location, road name, streets, etc. (road sign portions) and the other portion as a background of the road sign portions (background portions). The light scattered at the entire surface of the light guide plate 21 illuminates on the background portions as well as the road sign portions at the same time. It does not make any problem for the proper working of the road sign board, even if only one of the two portions (for example, the road sign portions only) emits light brightly and the other portion does not emit light. Rather, since the visibility gets better for larger difference in luminance between the road sign portions and the background portions, it may be preferable that only one of the road sign portions and the background portions emit light. Un hoe Baek's road sign board 1 overlooked such a point, and made the unnecessary portions emit light, too.

Also, Un hoe Baek's road sign board 1 covers the light-emitting board 20 with the top board 30 and it is not positive from a view point of light efficiency. According to the disclosure, the transparent top board 30 is made of compound resin and provides a function of protecting the light-emitting board 20. In order to endure the weather changes such as temperature, rain, snow, wind (gust), etc., engage stably with the base board 10, and protect the light-emitting board 20, the top board 30 must be made with a sufficient thickness. However, if the thickness of the top board 30 gets larger, then the light loss of the light-emitting board 20 also gets larger, lowing the electric energy efficiency. In order to minimize the light loss due to the thickness increase, the top board 30 must be made of a plate material with an excellent light transmission, but such plate material is very expensive, causing the increase of manufacturing cost.

Un hoe Baek's road sign board 1 seem not to provide a perfect waterproof structure. Any waterproof structure has not been mentioned, probably the light-emitting board 20 is not waterproof. Then, any moisture must not be allowed to enter the space between the base board 10 and the top board 30. For if a little bit of moisture enters, the space is moisturized, deteriorating the luminance of the light-emitting board 20. In the road sign board 1, the packing member 31 is the only means for waterproofing between the base board 10 and the top board 30. For a perfect waterproof with the packing member 31, the entire contacting surfaces of the base board 10, the packing member 31, and the top board 30 must be sealed perfectly. This makes it hard to manufacture the road sign board 1. Also, in disassembling and reassembling the top board 30 for maintenance, the installation of the packing member 31 for keeping the waterproof structures in the field is difficult and time-consuming.

Un hoe Baek's road sign board 1 may not be installed properly by using the existing non-illuminating type road sign board (existing road sign board). The disclosure said as if the road sign board 1 is installed newly, rather than being installed to the pre-existing road sign board.

As such, Un hoe Baek's road sign board 1 has problems to solve in terms of convenience of maintenance, light efficiency, waterproofing structures, installation, maintenance cost, etc.

SUMMARY OF INVENTION

Problems to Solved

Among the above various reasons causing the problems in the prior arts, the core problem seems to be the structure of covering the light-emitting boards 20 all with a top board 30 to be combined with the base board 10. The invention proposes a structural improvement for solving the problem. That is, an object of the invention is to provide a local light-emitting road sign board apparatus, in which when a specific light-emitting panel is broken out of a plurality of light-emitting panels for road sign, the broken light-emitting panel only can be detached with the other light-emitting panels intact, and checked, repaired, and reinstalled.

Another object of the invention is to provide a local light-emitting road sign board apparatus, in which the background portions of the road sign board does not emit light, but only the road sign portions emit light, so as to realize increase of readability of the road signs, energy saving, and manufacturing cost reduction at the same time.

Also, still another object of the invention is to provide a local light-emitting road sign board apparatus, which increasing the light efficiency by not unnecessarily blocking light from light-emitting panel for road sign.

Still another object of the invention is to provide a local light-emitting road sign board apparatus, in which it is not difficult to provide waterproofing structures in the time of maintenance.

Still another object of the invention is to provide a local light-emitting road sign board apparatus, which enables recycling of existing road sign board and lowering of manufacturing and maintenance cost, for it can use a pre-existing road sign board as an installation substrate and attach or detach there.

Solutions to Problems

According to an aspect of the invention for achieving the above goals, a locally light-emitting road sign board apparatus is provided, which comprises a main substrate, a locally light-emitting road sign set, a fixing means, and a substrate cover sheet. The main substrate is formed with one or more openings and provided for a background of a road sign. The local light-emitting road sign set comprises one or more local light-emitting panels, each of which emitting light generated by a light source forwards through a light guide plate, emitting locally only at road guide sign portion ('road sign portion') displaying road guides by letter, number, symbol, or figure among an entire area of the light guide plate but not at remaining portion ('sign background') that is a background for the road sign portion. The one or more local light-emitting panels are inserted and installed at a front of the main substrate one by one at the one or more openings, so as to display road guide information of a road over all. The fixing means is for fixing to the main substrate each of the local light-emitting panels inserted and installed at each opening at the front of the main substrate and for allowing a specific local light-emitting panel to be detached from the main substrate with the other local light-emitting panels left in place. The substrate cover sheet is attached to the surface for covering the main substrate and the sign background leaving the road sign portion only to be exposed and works as a non-illuminating background with respect to the road sign portion.

The substrate cover sheet preferably comprises a first cover sheet covering the main substrate except for the one or more opening portions and one or more second cover sheets, each of which covering the sign background of the one or more local light-emitting panels separately. And preferably a retroreflective sheet for retroreflecting light shone in the front of the road sign board apparatus is provided in the substrate cover sheet.

Preferably the local light-emitting road sign board apparatus further comprises one or more sub substrates that are sandwiched between a set of the local light-emitting panel and the second cover sheet attached to each other, and attached to them integrally so as to form a local light-emitting road sign unit. Each of the sub substrates covers the sign background only and opens at area facing the road sign portion of the light guide plate, and when the local light-emitting panel is inserted in the opening of the main substrate in order to install the local light-emitting road sign unit in the main substrate, the sub substrate is fixed to the main substrate by the fixing means while covering the opening of the main substrate completely, and a desired locally light-emitting road sign unit is detached from the main substrate independently from the other light guide plate road sign units by releasing only the fixing unit of the desired locally light-emitting road sign unit.

The locally light-emitting panel, according to an embodiment of the invention, comprises a light guide plate unit, a light source module, and a frame. The light guide plate unit is formed by including a light guide plate made of transparent acrylic plate member, a reflective sheet attached to a rear surface of the light guide plate and reflecting light escaping from the light guide plate back into the light guide plate, and a glue attaching the reflective sheet to the light guide plate. At least one of the light guide plate, the reflective sheet, and the glue is provided with a light-scattering element scattering incident light that is provided only at a region corresponding to the road sign portion but the light-scattering element is not provided at the other region, so that the incident light through a side surface of the light guide plate is scattered by the light-scattering elements, and light emits forwards only at the region corresponding to the road sign portion. The light source module is disposed closely at a side surface of the light guide plate and inputting light into the light guide plate through the side surface. The frame forms outer framework of the locally light-emitting panel by supporting the light source module closely to the side surface of the light guide plate and enclosing all along at least an edge side surface of the light guide plate unit.

According to another preferable embodiment, the locally light-emitting panel comprises a light guide plate, a light source module, a reflective sheet, and a frame. In the light guide plate, a light-scattering element scattering incident light is provided only at a region corresponding to the road sign portion out of the front surface and/or the rear surface of a transparent acrylic plate member but the light-scattering element is not provided at the other region, so that the incident light through a side surface of the light guide plate is scattered by the light-scattering elements, and light emits forwards only at the region corresponding to the road sign portion. The light source module is disposed closely at a side surface of the light guide plate and inputting light into the light guide plate through the side surface. The reflective sheet is for covering the rear surface of the light guide plate and reflecting light escaping from the rear surface back into the light guide plate. The frame supports the light source module closely to the side surface of the light guide plate and encloses edge perimeter portion of the light guide plate and the reflective sheet, forming an outer framework of the locally light-emitting panel.

The local light-emitting panel is preferably made in a waterproofing structure. For that, an edge perimeter of the reflective sheet is attached to the rear surface of the light guide plate without a gap so as to keep moisture from entering through between the reflective sheet and the rear surface of the light guide plate, and also all gaps related to the frame that are accessible attaching surfaces of the light source module, the light guide plate and the cover sheet are finished with waterproofing material.

The locally light-emitting panel further comprises a surface-protecting and/or color-expressing cover sheet for covering a front surface of the light guide plate, and wherein the edge perimeter of the cover sheet and the front surface of the light guide plate are preferably glued sealingly so as to keep moisture from invading therethrough. Also preferably the locally light-emitting panel further comprises a front surface cover sheet made of transparent material for covering the front surface of the light guide plate and is fixed to the frame, and preferably the gap between the front cover sheet and the frame is finished with waterproofing material so as to keep moisture from invading.

Preferably the main substrate is provided with an edge bent portion of a shape of ⊏ at an edge portion, and the height of the edge bent portion is larger than or substantially equal to the thickness of the locally light-emitting panel.

Effects of Invention

According to an locally light-emitting road sign board apparatus according to the invention, the effects and advantages may be obtained as follows.

Firstly, the maintenance is very convenient. Each road sign is formed with an independent locally light-emitting panel module. Each of the light guide plate panel module can be attached or detached conveniently at the front side of main substrate independently from the other panel modules. Therefore, when a light guide plate panel module is broken, the broken light guide plate panel module only can be detached from the main substrate with the others intact, and then can be replaced or repaired right away, to be reinstalled. The entire road sign board apparatus does not have to be disassembled, reducing time and cost for maintenance. Also, in a case that a specific light guide plate panel is broken, the entire functions of the road sign board may not be lost, but still working partially, even during the repairing period.

Secondly, it provides a clear readability. Out of the entire region of the road sign board, the road sign portions displaying letter, symbol, or figure for guiding the roads only emit light, while the other regions do not, making the brightness difference between the road sign portion and the sign background larger compared to the prior arts, so that the road sign portions are seen much clearly from the front.

Thirdly, it is possible to achieve a super power-saving structure. That is, since only the needy portions (road sign portions) emit light, it is possible to use a given amount of light maximally efficiently, minimizing the power consumption. Such features enables to use self-generated power like solar power generation, wind power generation, etc., instead of commercial electric power from the power company.

Fourthly, it provides a strong reliability against natural environment. Waterproofing structure is indispensable for the locally light-emitting road sign boards installed outdoors. If the entire apparatus is made waterproof as in the prior arts, then unnecessary portions are made waterproof, which is inefficient and costly. The invention can realize the optimal designing by providing waterproofing structure to minimum unit components out of the entire components. According to the invention, the locally light-emitting panel itself provides waterproofing structure. Therefore there is no possibility of malfunction due to moisture even in raining or snowing.

Fifthly, there is no need to provide a waterproofing in the installing location. The waterproofing structure of the light guide plate panel is obtained at the time of manufacturing of it in the factory. Therefore, in the location of installation of the road sign board apparatus, any separate measure does not have to be taken in order to provide waterproofing. The work for obtaining waterproof can be much easier and simpler in the factory, rather than in the installing location. Since there is no worry about providing waterproof, the works for installation or maintenance are much more convenient at the site.

Sixthly, it is possible to reduce manufacturing cost and installation cost. The road sign board according to the invention has components that are fewer and of a simpler structure, compared with the prior arts. Also, the components can be standardized. Due to the improved light efficiency, the number of LED elements can be reduced, compared with the prior arts. Thanks to these, the manufacturing cost can be reduced. Also, since it can be added to the regular road sign board conveniently, the regular equipments and resources can be reused maximally and the installation cost can be reduced a lot.

DETAILED DESCRIPTION OF EMBODIMENTS OF INVENTION

Below, preferable embodiments of the invention are described in detail referring to the attached drawings.

Figure 1:
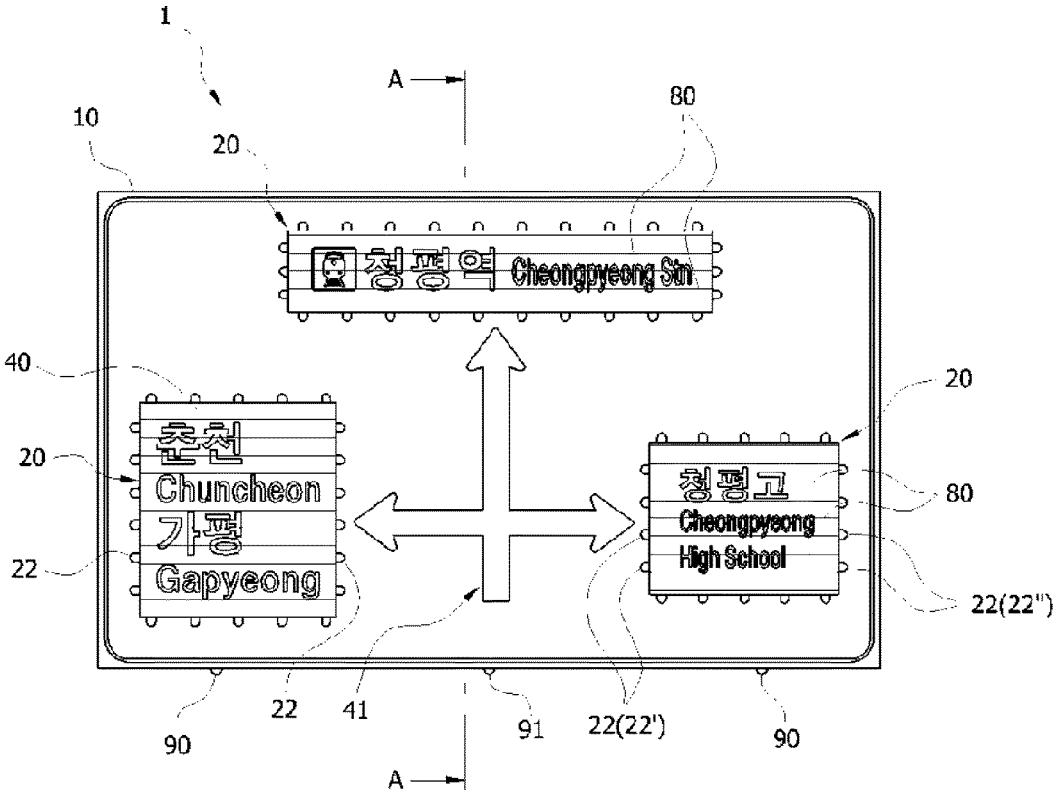
Figure 1 (PRIOR ART)
FIG. 1 is a front view of a locally light-emitting road sign board according to prior arts.
Figure 2:
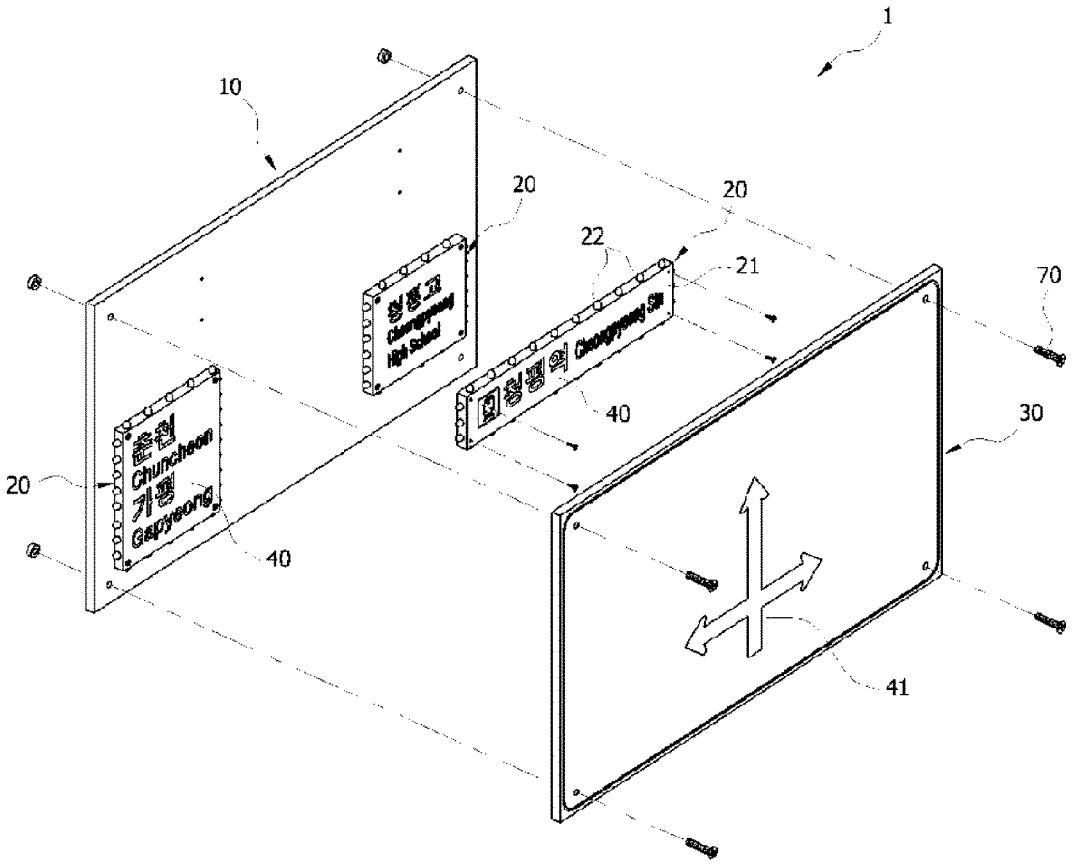
Figure 2 (PRIOR ART)
FIG. 2 is an exploded perspective view of a locally light-emitting road sign board according to prior arts.
Figure 3:
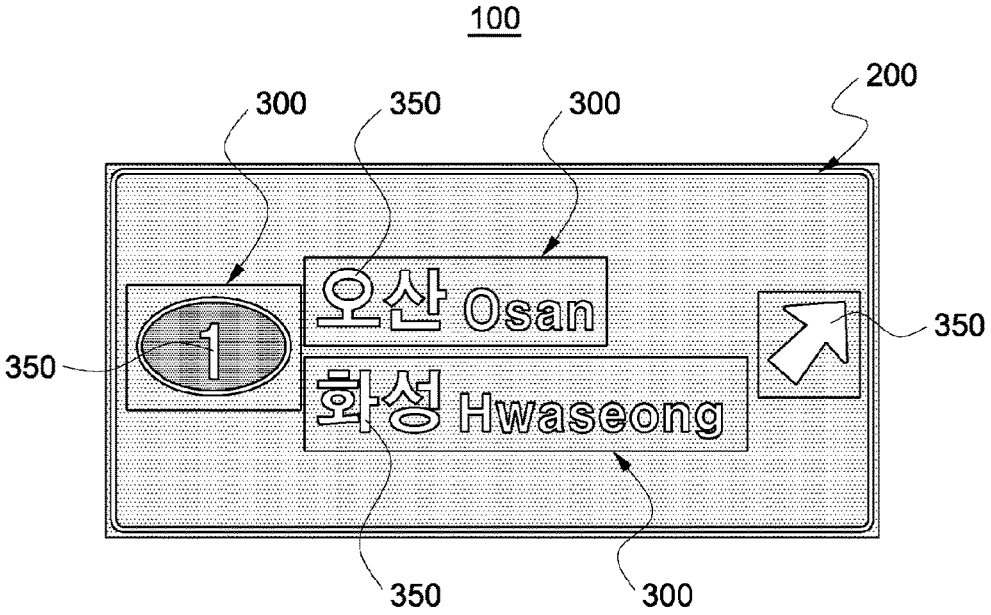
FIG. 3 is an assembling view of a locally light-emitting road sign board according to the invention.

FIG. 3 shows an outlook of an assembled locally light-emitting road sign board apparatus 100 ('road sign board' below) according to the invention. The road sign board 100 includes a main substrate unit 200 and one or more locally light-emitting road sign unit 300. In the main substrate unit 200 is provided a groove or opening 220 where the locally light-emitting road sign unit 300 can be inserted and installed. When a maintenance is needed, a specific locally light-emitting road sign unit 300 only can be detached from the main substrate unit 200.

Figure 4:
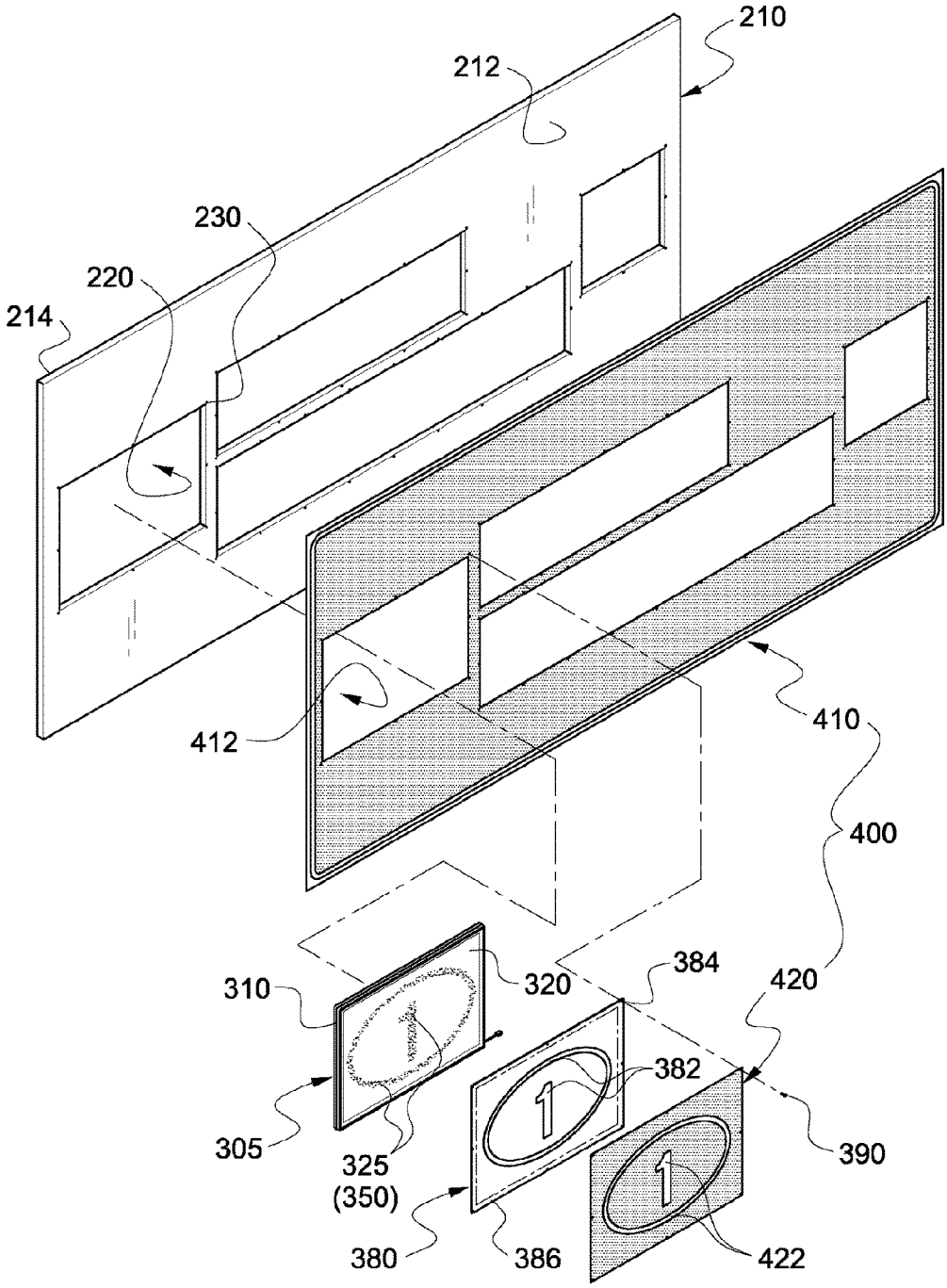
FIG. 4 is an exploded perspective view of a locally light-emitting road sign board according to the invention, FIG. 5(*a*) and FIG. 5(*b*) are side views of a main substrate shown in FIG. 4.

FIG. 4 shows a road sign board 100 in a disassembled state. First, the main substrate unit 200 includes a main substrate 210 and a cover sheet 410 attached to its surface. The locally light-emitting road sign unit 300 includes a locally light-emitting panel 305, a sub substrate 380 attached to its front surface, and a cover sheet 420 attached to a surface of the sub substrate 380.

Figure 5:
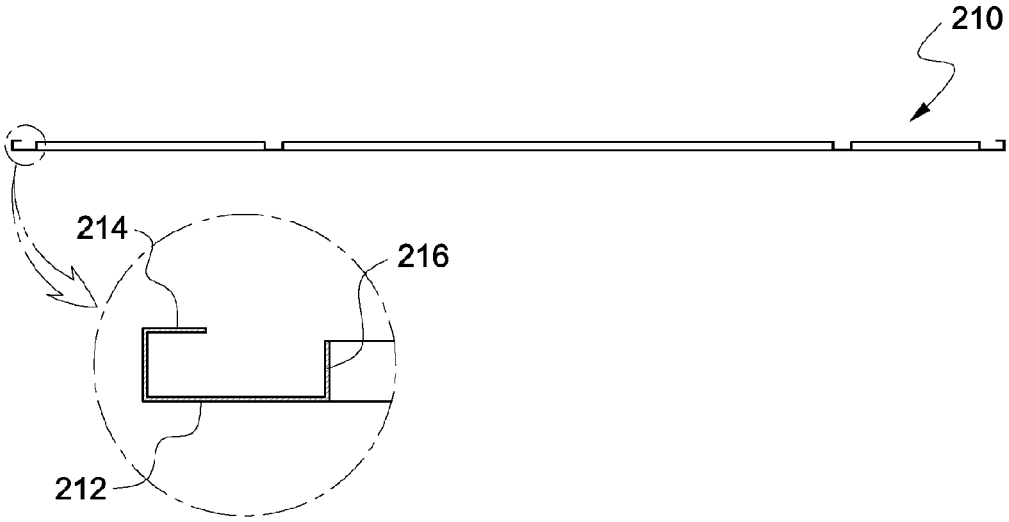
Figure 5:
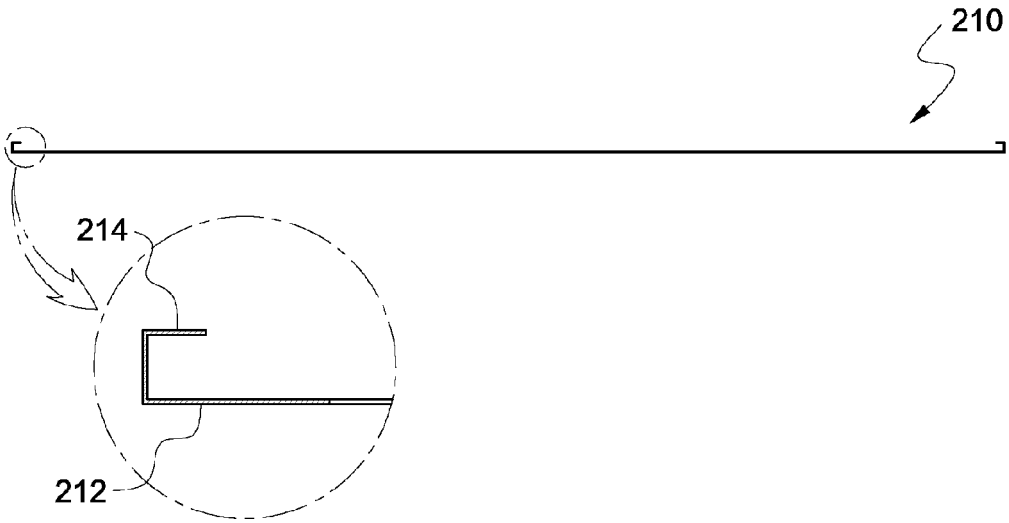

The main substrate 210 is a substrate forming a base of the road sign board, installed on the road, and made of weather-resistant material that is not damaged by snow, rain, or gust, for example, a metal plate. In the main substrate 210 are formed a plurality of groove or openings 220. Around each of the openings 220 are provided a plurality of bolt-engaging holes 230. Each of the openings 220 may provide a light guide plate 216 formed by being bent inwards at a bordering portion of the opening 220 as shown in FIG. 5(*a*), or be an opening without a side wall as shown in FIG. 5(*b*). The opening 220 can be made, for example, by a laser cutting process.

Preferably, an edge bent portion 214 of the shape of ⊏ is provided by bending an edge portion of the main substrate 210 by 90 degrees twice. The edge bent portion 214 may be used as a mean to attach the main substrate 210 to a conventional road sign board 500 (for example, to provide a bolt-engaging hole in the edge bent portion 214 and attach to the conventional road sign board 500 with a bolt, or by welding the edge bent portion 214 to the conventional road sign board 500). Also, the height of the edge bent portion 214 is preferably not smaller than the thickness of the locally light-emitting panel 305. Then, since the main substrate 210 is put away as far as the height of the edge bent portion 214 from the conventional road sign board 500, the locally light-emitting panel 305 is not going to be pressed down by the conventional road sign board 500.

The light guide plate panel 305 is a device that send forwards light generated by the light source through the light guide plate. The feature of the light guide plate panel 305 is that it emits light brightly only where it is desirable, that is, at the road sign portion ('road sign portion 350' below) such as letter, number, symbol, figure, etc. for road guide. The other portion that becomes a background to the road sign portions ('sign background 355' below) do not have any pixels, not emitting light. The light guide plate panel 305 is manufactured as many as the number of the opening 220 and with a size for being inserted to the opening 220.

On the front surface of the light guide plate panel 305 is attached the sub substrate 380, being integrally. It is attached so strong that it would not be fallen at snow, rain, or gust. It can be fixed by providing a separate attaching structure or using a strong glue 460. Preferably, the light guide plate panel 305 may be fixed to the main substrate 210 through the sub substrate 380. For that, it is preferable to make the sub substrate 380 a little larger than the light guide plate panel 305, so that when the sub substrate 380 covers the front surface of the light guide plate panel 305 entirely, it circumnavigates the circumference and leaves an extra portion. The extra portion is used as an engaging portion 386 with respect to the main substrate 210. For that, a plurality of bolt-engaging holes 384 are provided at locations in the engaging portion 386 corresponding to the bolt-engaging holes of the main substrate 210. Also, an opening 382 is made by cutting out a portion of the sub substrate 380 corresponding to the road sign portion 350, so that light from the road sign portion 350 passes through without being hindered. The surface of the sub substrate 380 is fixed and covered with the cover sheet 420. Through the cover sheet 420 are provided openings 422, each having the same sizes and shapes as the road sign portion 350 at locations corresponding to the road sign portion 350.

The sub substrate 380 and the cover sheet 420 are laminated and attached to the light guide plate panel 305 by aligning well, so that the road sign portion 350 is exposed completely. Such assembly, that is, the locally light-emitting road sign units 300 are installed one by one on the corresponding openings 220. That is, the light guide plate panel 305 is inserted into the opening 220, and the engaging portion 386 of the sub substrate 380 is straddled around the perimeter of the opening 220 of the main substrate 210. And, in that state, the bolts 390 are engaged to the bolt-engaging holes 384, 230. If necessary, the locally light-emitting road sign unit 300 can be detached from the main substrate 210 by releasing the engaging of the bolts 390.

In FIG. 4, the bolt 390 is shown for a fixing means 390 with respect to the main substrate 210 of the locally light-emitting road sign unit 300, but other kinds of well-known fixing means can be used. However, they must enable to install each locally light-emitting road sign unit 300 in the front by inserting into the opening 220, and also a specific locally light-emitting road sign unit 300 only can be disassembled without disassembling of the other locally light-emitting road sign unit 300.

In the above, how to attach the sub substrate 380 to the light guide plate panel 305 has been described, but sometimes the sub substrate 380 may be omitted. For that, it needs to make the light guide plate panel 305 so as to be fixed to the opening 220 of the main substrate 210. For example, an engaging portion (not shown) for engaging the frame 310 of the light guide plate panel 305 to the main substrate 210 may be further provided with the frame 310. In such a case, the locally light-emitting road sign unit 300 includes the light guide plate panel 305 and the cover sheet 420 attached directly to the front surface thereof.

[Other Embodiments of Invention]

Figure 6:
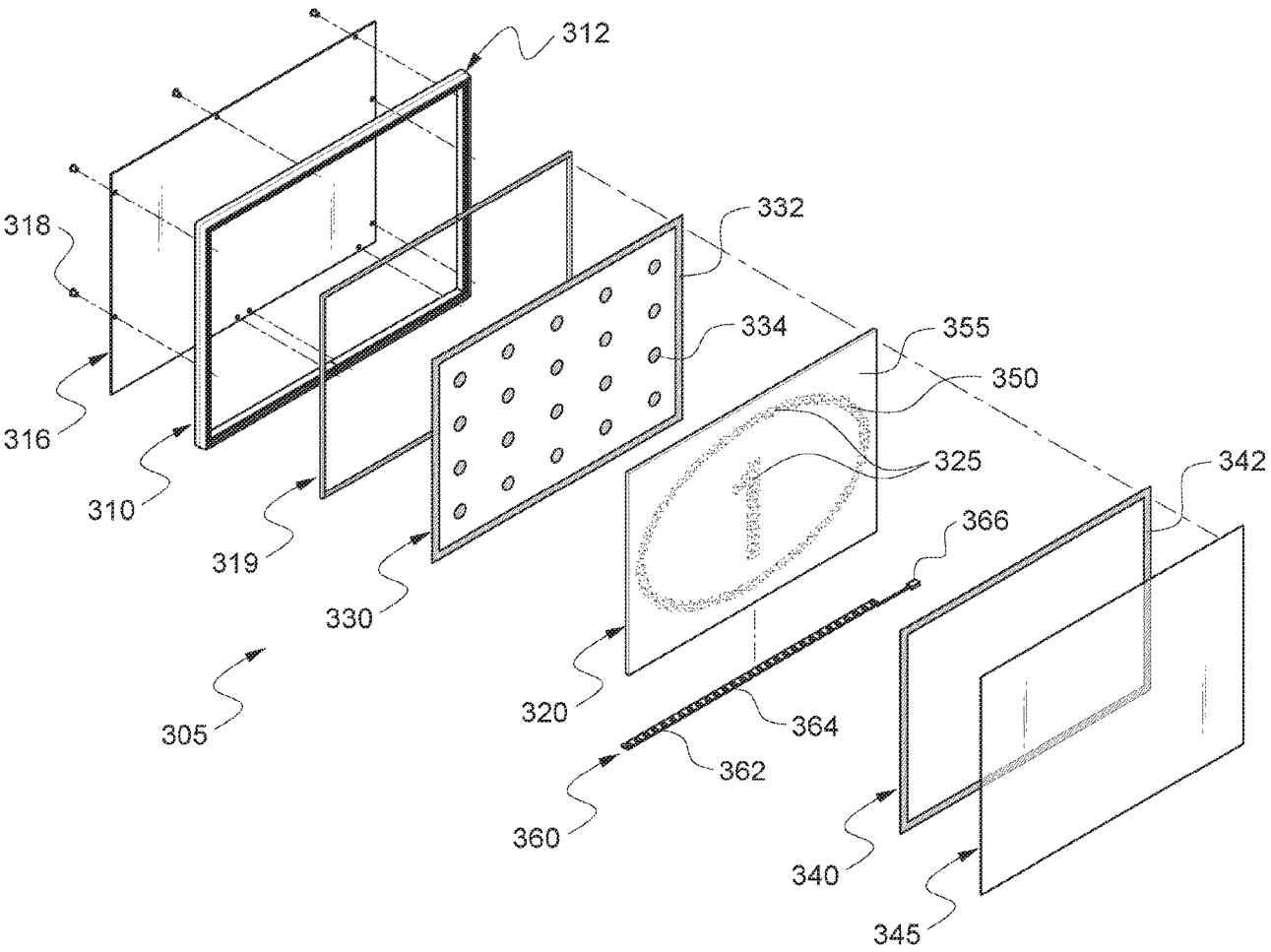
FIG. 6 is an assembling view and a cross-sectional view of a light guide plate panel to be installed in the openings of FIG. 5, FIG. 7(*a*) and FIG. 7(*b*) are side views of another embodiments of a light guide plate panel.

FIG. 6 shows an example of a light guide plate panel 305 according to the invention. The light guide plate panel 305 adopts the light-scattering element 325 only on the light guide plate 320 and on the regions corresponding to the road sign portion 350. The light guide plate 320 is made by cutting acrylic plate, preferably polymethyl methacrylate (PMMA), in a desirable dimension. The light-scattering element 325 may be conventional ones including minute engravings that is as small as invisible to naked eyes, a plurality of ink dot having light-scattering particles, a plurality of V-cut grooves, etc. Such light-scattering element 325 is preferably formed on the rear surface of the light guide plate 320, but the minute engravings may be formed on the front surface.

It is connected to an electric power source (not shown) through a connector 366. A reflective sheet 330 is attached to a rear surface of the light guide plate 320. The light guide plate 320 and the reflective sheet 330 are attached to each other sealingly all around the edge, so that no moisture intrudes therebetween (for example, using a double-sided tape). Since it would be better for the quality of output light that the reflective sheet 330 contacts evenly and closely all across the entire rear surface of the light guide plate 320, as shown it is going to be preferable to dispose a transparent glue 334 evenly on the surface and attach to the light guide plate 320. A rear surface cover plate 316 can be further added to the rear side of the reflective sheet 330 for protecting it. On the front surface of the light guide plate 320 can be attached a transparent cover sheet 340 for protecting the light guide plate surface and/or expressing color. Also, A front cover plate 345 made of transparent material may cover the front surface of the light guide plate 320 and be fixed to the frame 310. In the case that the cover sheet 340 is attached, it is also preferable that the light guide plate 320 and the cover sheet 340 are attached to each other sealingly all around the edge for blocking moisture intruding therebetween.

On at least one side surface of the side surfaces of the light guide plate 320 is closely disposed a light source module 360. The light source module 360 includes a wiring board 362 disposed long along a side surface of the light guide plate 320, a plurality of LEDs 364 disposed serially there, and wire and connectors 366 connected to the wiring board 362.

Figure 7:
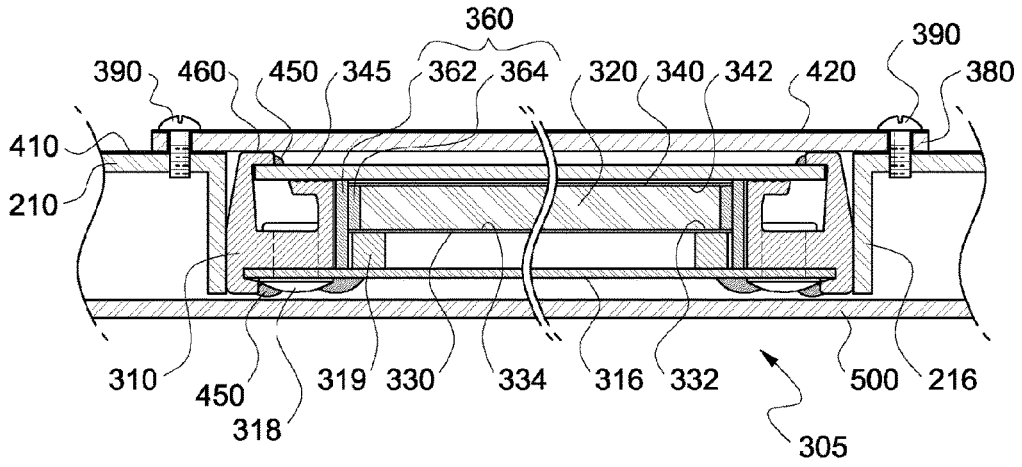
Figure 7:
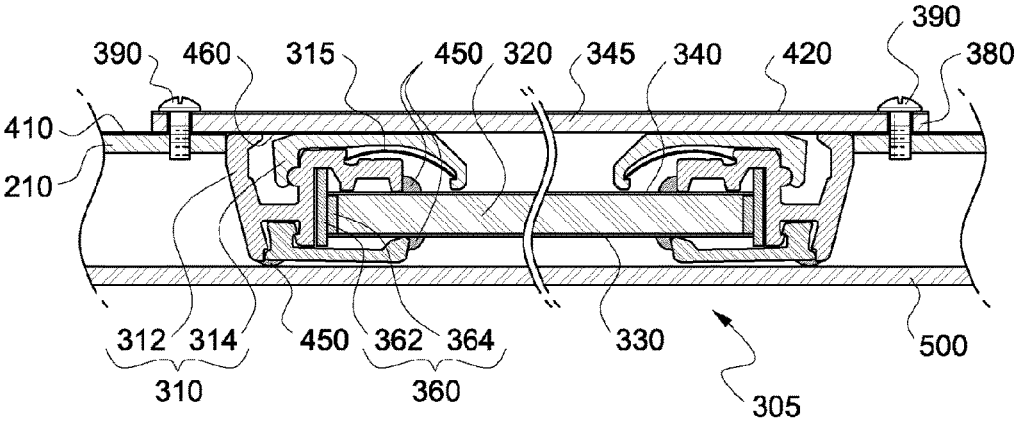

These components are assembled into a single module via the frame 310. FIG. 7(*a*) shows a cross-sectional view of an assembled state of the light guide plate panel 305. The frame 310 supports the light source module 360 so as to be disposed closely to a side surface of the light guide plate 320, and encloses the edge side of the light guide plate 320 and the reflective sheet 330 entirely. The frame is preferably made of aluminum material that is light and workable. At a lower end of the frame 310 is fixed the rear surface cover plate 316 covering the frame 310 and the reflective sheet 330 entirely, for example, with rivets 318, and at an upper end of the frame 310 is attached the front cover plate 345 covering the cover sheet 340 and the light guide plate 320 entirely, for example, with a strong glue 460. By these, the frame 310 becomes an outer framework assembling all the components of the light guide plate panel 305 into a single body. By disposing a spacer 319 between the light guide plate 320 and the rear surface cover plate 316, the looseness due to the difference between the interval between the front cover plate 345 and the rear surface cover plate 316 and the thickness of the light guide plate 320 is removed. And in order to have waterproofing structure in the light guide plate panel 305, the gaps of the frame 310 that access the light source module 360 and the attaching surface edge of the light guide plate 320 and the two sheets 330, 340 and the gaps between the frame 310 and the front cover plate 345 are all finished, for example, with waterproofing material 450 such as silicone.

FIG. 7(*b*) shows another structure of a light guide plate panel 305. The light guide plate panel 305 shown in FIG. 7(*b*) does not adopt the front cover plate 345 and the rear surface cover plate 316. Also, the frame 310 may be formed with a frame main body 312 for receiving inside therein and supporting the light source module 360 and holding and supporting the edge perimeter of light guide plate unit at the upper and lower sides to which the cover sheet 340 and the reflective sheet 330 are attached to the front surface and the rear surface of the light guide plate 320, and a frame cover 314 engaging rotatably (able to open and close) with a top portion of the frame main body 312 and supporting the edge perimeter of the light guide plate 320 and the cover sheet 340. In order to provide force keeping each of the closed state and the open state of the frame cover 314, a plurality of plate springs 366 are embedded in the frame cover 314.

Next, a structure is described, which is for enabling the light guide plate panel 305 to emit light locally at the road sign portion 350 only. In order for light of LCD 362 from the side surface of the light guide plate 320 passes the front surface of the light guide plate, the incident angle of light beam entering into the front surface of the light guide plate 320 must be smaller than the critical angle of the light guide plate material (acrylic plate member). The light-scattering element is a component for making such light beam, which scatters (diffused reflection) light incident on itself and outputs at least some of the light beam satisfying the critical angle condition through the front surface of the light guide plate. When viewed from the front direction of the light guide plate 320, it looks as if the light-scattering element emits light (in such a sense, the light-scattering element may be called light-emitting pixels of the light guide plate). In the invention based on such effects, the light guide plate panel 305 is formed with light-scattering element only at the regions corresponding to the road sign portions 350 (letters, numbers, symbols, or patterns) out of the entire region, but not on the remaining region. The light-scattering element may be formed at least one of the light guide plate 320, the reflective sheet 330, and the glue (limited to the glue applied to the region corresponding to the road sign portion 350) attaching the light guide plate 320 and the reflective sheet 330.

FIG. 6 shows a case that the light-scattering element 325 is formed on the light guide plate 320. The light-scattering element 325 may be minute engravings formed, for example, at least one surface of the rear surface and the front surface of the light guide plate 320. The minute engravings may be formed with sand-blasting process by exposing the corresponding regions of the road sign portion 350 of acrylic material and covering the other regions. The sand-blasting process preferably uses sand grains of about 30~400 mesh.

A first process can be done with sand grains of one size, or first and second processes can be done with sand grains of two sizes. In the two step process, for example, the first process is done by blasting one side surface of an acrylic plate member with sand grains of a large size (30-80 mesh, for an example) using a first blasting device (not shown), and then the second process is done by blasting sand grains of a size (120-250 mesh, for an example) smaller than the sand grains in the first process using a second blasting device (not shown). Some of second engravings formed by the second process may be located in the engravings formed by the first process, forming a multiple engraving structure of engravings-in-engravings, and others may be formed on a smooth surface outside. More details on the two steps process were described in Korean Patent No. 10-1116175 by the inventor, titled "Light guide plate having light-scattering elements of engravings-in-engravings structure and manufacturing method thereof". And, the manufacturing method of minute engravings disclosed there would be included by reference here as a part of the invention. In such a sand-blasting process, it is preferable to have at least one of distribution density, size, and depth of minute engraving (pixel) get larger and larger with a distance from the side surface on which the light source module 360 is disposed in order to obtain the luminance evenness of the road sign portion 350.

Figure 8:
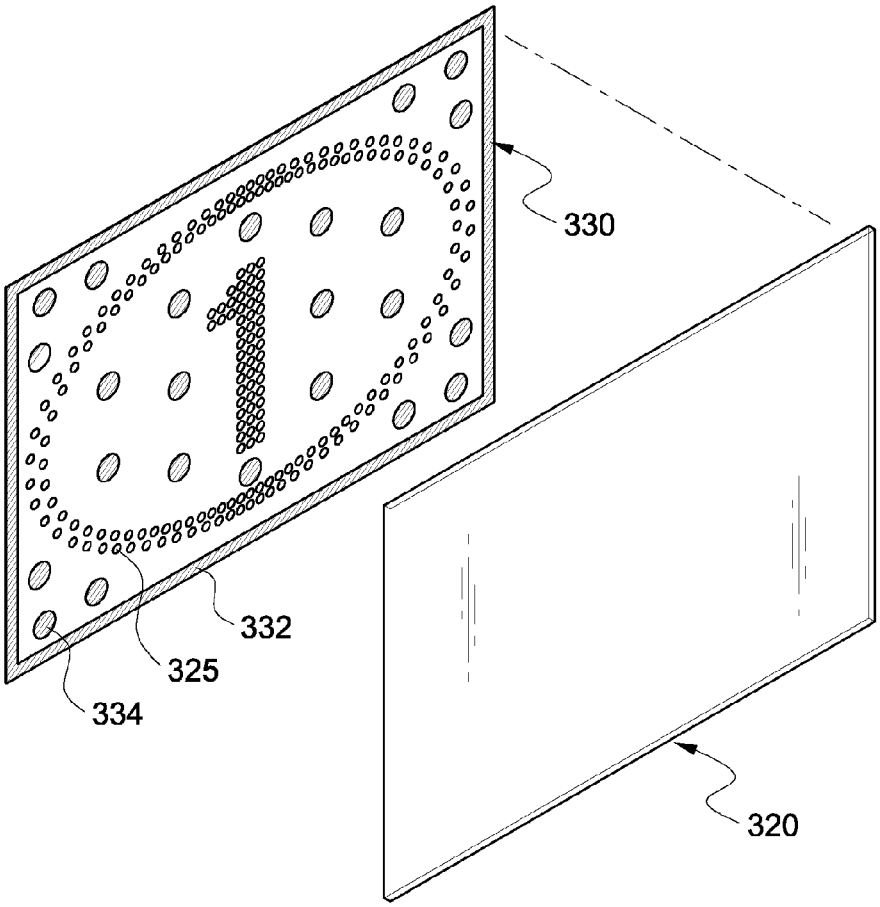
FIG. 8 shows an example, in which ink-dot type light-scattering elements are formed on a cover sheet road sign portion, not a light guide plate.

FIG. 8 shows a case that the light-scattering element 325 made of ink dot are formed on the reflective sheet 330 only. The light-scattering element 325 made of ink dot are formed only on the ellipsis and number 1, that is the road sign portion 350, out of the entire region of the reflective sheet 330. It is preferable to have the reflective sheet 330 attached closely to the light guide plate 320 with glue 334 and double-sided tape 332. In the ink dot is included minute bead particles for scattering incident light, and therefore the light-scattering effects can be obtained. For the luminance evenness of the road sign portion 350, it is preferable that at least one of size and density of ink dots increases as getting away from the light source. Instead of ink dots, a method may be used, in which an area of the reflective sheet 330 corresponding to the road sign portion 350 is made a rough surface, smeared with a transparent glue, and attached to the light guide plate 320. The rough surface of the reflective sheet 330 may be one of (i) a surface formed with irregular shaped protrusions, engravings, or grooves, (ii) a surface formed with regular shaped protrusions, engravings, or grooves, (iii) a surface formed with a dispersing bead layer including light-scattering beads reflecting diffusely incident light.

Also, not shown, but it is possible to form the two kinds of light-scattering elements described in the above compoundly. That is, as shown in FIG. 6, the minute engravings are formed on the light guide plate 320, and as shown in FIG. 8, the ink dots are formed on the reflective sheet 330. In such a case, in order to have the luminance evenness of the road sign portion 350, the ink dots are formed with same size and distribution density regardless of the distance from the light source, and the minute engravings are formed preferably so as to have at least one of the distribution density, size, and depth larger and larger with the distance from the light source. Also, alternatively, glue component may be added to the ink dots, so that the ink dots may works also as attaching the reflective sheet 330 to the light guide plate 320.

Figure 9:
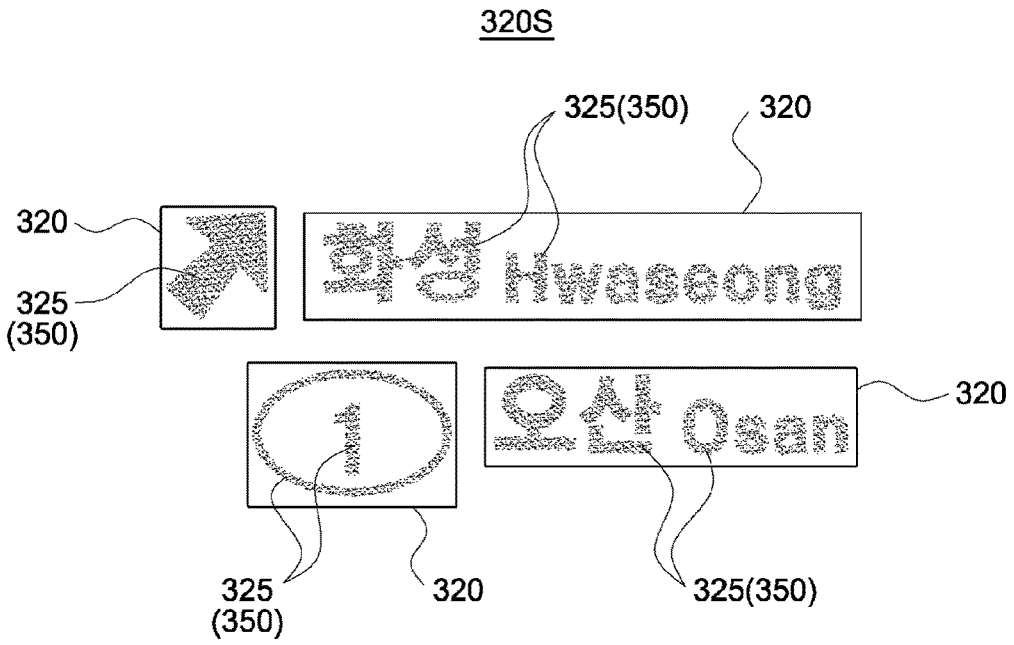
FIG. 9 shows the entire light guide plates to be used in the road sign board of FIG. 3, in which light-scattering elements formed on the road sign portions only.

FIG. 9 shows all the light guide plates 320 to be used in the road sign board 100 of FIG. 3. In the light guide plates 320 are formed the light-scattering elements, for example minute engravings only on the region of the road sign portion 350. The road sign board 100 includes four road sign portions 350 such as two region names (오산 Osan, 화성 Hwaseong) and exit arrows to the regions, and road number ①. Each of the four road sign portions 350 is realized with separate light guide plate 320. That is, on the surface of the light guide plate 320 made of four acrylic plates are formed the light-scattering elements (minute engravings) 325 in shapes same as the four road sign portions 350.

Figure 10:
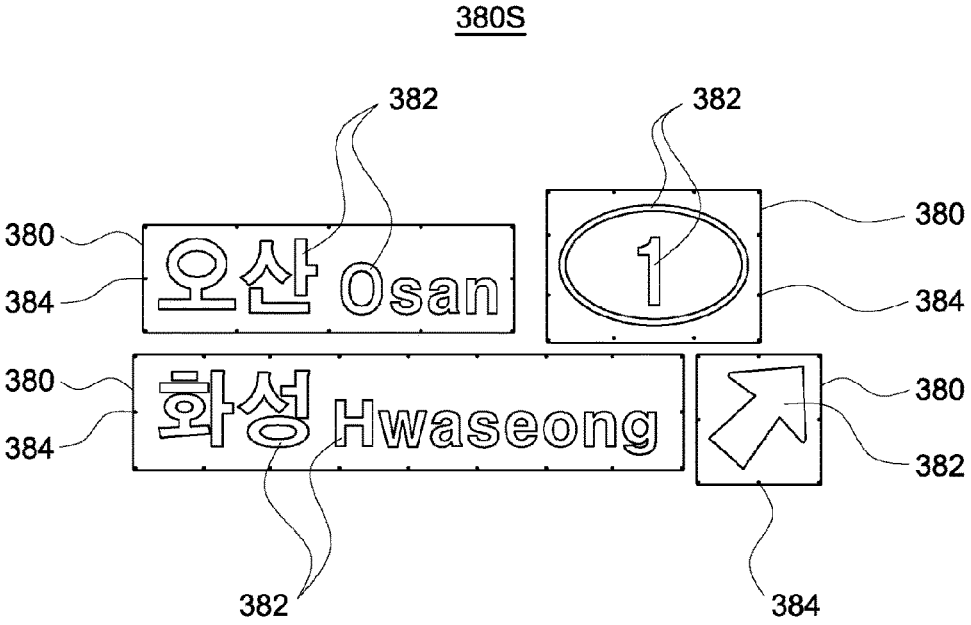
FIG. 10 shows an entire sub substrates to be used in the road sign board of FIG. 3.

FIG. 10 shows all the sub substrates 420 to be used in the road sign board 100 of FIG. 3. The sub substrates 420 are provided for the four light guide plates by four, and in each of the sub substrates 420 is provided the opening 422 of the same shape as that of the light-scattering elements formed in the corresponding light guide plate 320. Each of the sub substrates 420 is attached to the corresponding light guide plate 320 so that the region where the light-scattering element 325 are formed, that is, only the road sign portion 350 is exposed and the other regions are covered entirely. By such attaching, the light scattered at the light-scattering element 325 of the light guide plate 320 is output forwards through the opening 422.

The other regions in the front surface of the road sign board 100, except for the road sign portion 350, are covered by the cover sheets 410, 420, being attached. The cover sheet 410 for the main substrate 210 and the cover sheet 420 for the sub substrate 380 are provided separately. Each of the cover sheets 420 for the sub substrate 380 is provided separately for each sub substrate 380. In each cover sheet 420 is formed an opening 422 that is same as the opening 382 provided in the sub substrate 380 to be attached. In the cover sheet 410 for the main substrate 210 are formed with openings 412 of the same size as each of the opening 220 at the locations corresponding to the openings 220 formed in the main substrate 210.

The cover sheets 410, 420 form a background for the road sign portion 350. Since the road sign portion 350 emits light for themselves while the cover sheets 410, 420 do not, so that the brightness difference is maximized, resulting in an excellent visibility. In these cover sheets 410, 420 may be provided with retroreflective elements for retroreflecting light shone from vehicles in the front of the road sign board 100 and return to the vehicles. By these, even when the locally light-emitting panel 305 is out of order or there is a power failure, still it can work as a road sign.

The road sign board 100 described in the above may be manufacture in a factory. The components may be prepared and assembled as follows. The cover sheet 410 is attached to the main substrate 210 so that the openings 220, 412 formed in each of them are aligned with each other. Also, for each of the road sign portion 350, a set of the light guide plate panel 305, the sub substrate 380, and the cover sheet 420 is aligned with one another and laminate-fixed with the road sign portion 350 as a criterion. By these, the locally light-emitting road sign unit 300 showing the four road sign portions is completed. The locally light-emitting road sign units 300 are inserted into the corresponding openings 220 at the front side of the main substrate 210, and the bolts 390, the fixing means, are inserted into and engaged with the bolt-engaging holes 230, 384. By this, the assembling of the road sign board 100 is completed.

Figure 11:
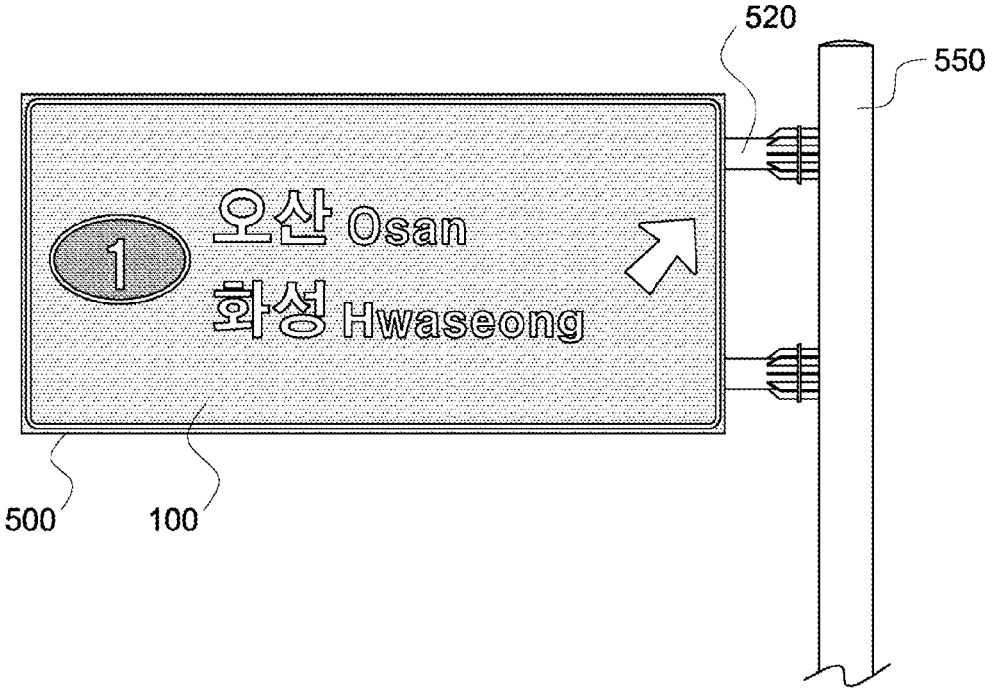
FIG. 11 is a front view of a state, in which a locally light-emitting road sign board according to the invention is installed additionally to a regular road sign board.
Figure 12:
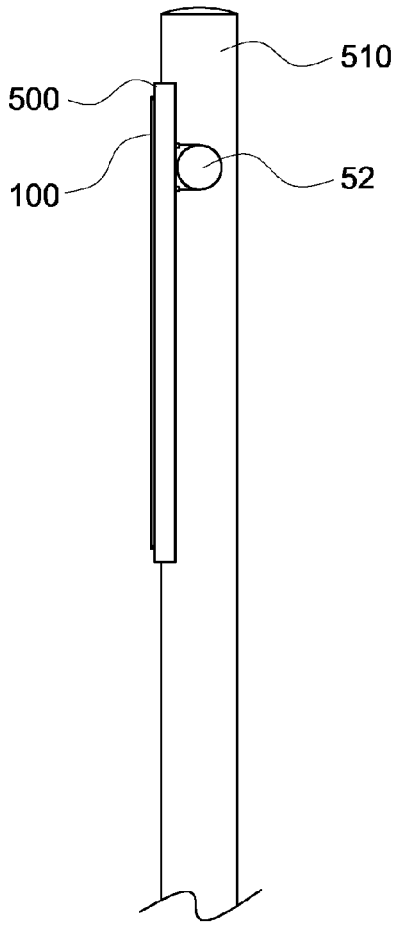
FIG. 12 is a side view of a state, in which a locally light-emitting road sign board according to the invention is installed additionally to a regular road sign board.

The road sign board 100 assembled as in the above is installed on the road using separate supporting means. FIGS. 11 and 12 show how to install using a non-illuminating road sign facility that was installed already, that is, sign-supporting pole 550, sign-supporting cross beam 520, and the regular non-illuminating road sign board 500. It can be installed simply by fixing the main substrate 210 to the conventional road sign board 500, for example, using methods such as bolt assembling, welding, etc. Since the pre-existing facility can be reused, the manufacturing cost of road sign board and the installation cost can be reduced a lot, and it is good in the sense of recycling of resources. Of course, in the locations without pre-existing road sign facility, a road sign pole 550 and the road sign supporting cross beam 520 may be installed newly and then the main substrate 210 can be fixed to the cross beam 520.

The assembling method of the road sign board 100 of the invention provides a method in which the main substrate 210 is not moved, and the locally light-emitting road sign unit 300 only is moved in front of the main substrate 210, to be engaged. Also, the locally light-emitting road sign units 300 may be attached to the main substrate 210 from one another, and also disassembled, independently. It is so in terms of mechanics as well as electronics. That is, the power to the light source module 360 of the locally light-emitting road sign unit 300 can be supplied from the power source (not shown) in parallel. Therefore, installation or detaching of any one locally light-emitting road sign unit 300 with respect to the main substrate 210 does not give any influence to the other locally light-emitting road sign unit 300.

According to such an assembling work, when a specific locally light-emitting road sign unit 300 is out of order and checking, repairing, or replacing of it is needed, it is possible that other components can be left as they are and only the specific locally light-emitting road sign unit 300 can be detached. That is, in the location where the road sign board 100 is installed, the worker can detach the locally light-emitting road sign unit 300 from the main substrate 210 by unscrewing the bolts 390 fixing the locally light-emitting road sign unit 300 in the front of the locally light-emitting road sign unit 300 leaving the main substrate 210 fixed to the road sign supporting pole 550 and the road sign supporting cross beam 520 (or fixed to the pre-existing conventional road sign board 500 fixed to them). Then, the locally light-emitting road sign unit 300 that is checked and repaired on the ground or a new locally light-emitting road sign unit 300 may be installed in the corresponding opening 220 of the main substrate 210, to be engaged there. Like this, since the broken locally light-emitting road sign unit 300 only can be detached selectively and repaired or replaced with the locally light-emitting road sign unit 300 and other components intact, the maintenance can be done swiftly and conveniently, and also the associated cost can be reduced a lot.

Also, since the light generated by the light source module 360 is collected and output outside, the light efficiency can be maximized, and therefore the power consumption may be reduced a lot. Therefore, it can be operated upon power self-generated locally using solar light or wind, not a commercial power, as the power source of the light source module 360.

Furthermore, in the case of detaching a specific locally light-emitting road sign unit 300 from the main substrate 210 for maintenance and reinstalling it, it can be treated simply with waterproofing material (silicone) again. In a case of replacing the broken one with a new one, there is no need to worry about waterproofing.

The invention claimed is:

1. A local light-emitting road sign board apparatus comprising:

a main substrate formed with one or more openings and provided for a background of a road sign;

a local light-emitting road sign set comprising one or more local light-emitting panels, each of which emitting light generated by a light source forwards through a light guide plate, emitting locally only at road guide sign portion ('road sign portion') displaying road guides by letter, number, symbol, or figure among an entire area of the light guide plate but not at remaining portion ('sign background') that is a background for the road sign portion, wherein the one or more local light-emitting panels are inserted and installed at a front of the main substrate one by one at the one or more openings, so as to display road guide information of a road over all;

a fixing means for fixing to the main substrate each of the local light-emitting panels inserted and installed at each opening at the front of the main substrate and for allowing a specific local light-emitting panel to be detached from the main substrate with the other local light-emitting panels left in place; and a substrate cover sheet attached to a surface for covering the main substrate and the sign background leaving the road sign portion only to be exposed and working as a non-illuminating background with respect to the road sign portion, wherein the substrate cover sheet comprises a first cover sheet covering the main substrate except for the one or more opening portions and one or more second cover sheets, each of which covering the sign background of the one or more local light-emitting panels separately, and wherein the local light-emitting road sign board apparatus further comprises one or more sub substrates that are sandwiched between a set of the local light-emitting panel and the second cover sheet attached to each other, and attached to them integrally so as to form a local light-emitting road sign unit, wherein each of the sub substrates covers the sign background only and opens at area facing the road sign portion of the light guide plate, wherein when the local light-emitting panel is inserted in the opening of the main substrate in order to install the local light-emitting road sign unit in the main substrate, the sub substrate is fixed to the main substrate by the fixing means while covering the opening of the main substrate completely, and a desired locally light-emitting road sign unit is detached from the main substrate independently from the other light guide plate road sign units by releasing only the fixing unit of the desired locally light-emitting road sign unit.

2. The local light-emitting road sign board apparatus of claim 1, wherein a retroreflective sheet for retroreflecting light shone in the front of the road sign board apparatus is provided in the substrate cover sheet.

3. The local light-emitting road sign board apparatus of claim 1, wherein the locally light-emitting panel comprises:

a light guide plate unit formed by including a light guide plate made of transparent acrylic plate member, a reflective sheet attached to a rear surface of the light guide plate and reflecting light escaping from the light guide plate back into the light guide plate, and a glue attaching the reflective sheet to the light guide plate, wherein at least one of the light guide plate, the reflective sheet, and the glue is provided with a light-scattering element scattering incident light that is provided only at a region corresponding to the road sign portion but the light-scattering element is not provided at another region not corresponding to the road sign portion, so that the incident light through a side surface of the light guide plate is scattered by the light-scattering elements, and light emits only at the region corresponding to the road sign portion;

a light source module disposed closely at a side surface of the light guide plate and inputting light into the light guide plate through the side surface; and a frame forming an outer framework of the locally light-emitting panel by supporting the light source module closely to the side surface of the light guide plate and enclosing all along at least an edge side surface of the light guide plate unit.

4. The local light-emitting road sign board apparatus of claim 3, wherein an edge perimeter of the reflective sheet is attached to the rear surface of the light guide plate without a gap so as to keep moisture from entering through between the reflective sheet and the rear surface of the light guide plate.

5. The local light-emitting road sign board apparatus of claim 3, wherein the locally light-emitting panel further comprises a surface-protecting and/or color-expressing cover sheet for covering a front surface of the light guide plate, and wherein the edge perimeter of the cover sheet and the front surface of the light guide plate are glued sealingly so as to keep moisture from invading therethrough.

6. The local light-emitting road sign board apparatus of claim 3, wherein the locally light-emitting panel further comprises a front surface cover sheet made of transparent material for covering a front surface of the light guide plate and is fixed to the frame, and wherein a gap between the front cover sheet and the frame is finished with waterproofing material so as to keep moisture from invading.

7. The local light-emitting road sign board apparatus of claim 1, wherein the locally light-emitting panel comprises:

a light guide plate, in which a light-scattering element scattering incident light is provided only at a region corresponding to the road sign portion out of the front surface and/or the rear surface of a transparent acrylic plate member but the light-scattering element is not provided at another region not corresponding to the road sign portion, so that the incident light through a side surface of the light guide plate is scattered by the light-scattering elements, and light emits only at the region corresponding to the road sign portion;

a light source module disposed closely at a side surface of the light guide plate and inputting light into the light guide plate through the side surface;

a reflective sheet for covering the rear surface of the light guide plate and reflecting light escaping from the rear surface back into the light guide plate; and a frame forming an outer framework of the locally light-emitting panel by supporting the light source module closely to the side surface of the light guide plate and enclosing edge perimeter portion of the light guide plate and the reflective sheet.

8. The local light-emitting road sign board apparatus of claim 7, wherein an edge perimeter of the reflective sheet is attached to the rear surface of the light guide plate without a gap so as to keep moisture from entering through between the reflective sheet and the rear surface of the light guide plate.

9. The local light-emitting road sign board apparatus of claim 7, wherein the locally light-emitting panel further comprises a surface-protecting and/or color-expressing cover sheet for covering a front surface of the light guide plate, and wherein the edge perimeter of the cover sheet and the front surface of the light guide plate are glued sealingly so as to keep moisture from invading therethrough.

10. The local light-emitting road sign board apparatus of claim 7, wherein the locally light-emitting panel further comprises a front surface cover sheet made of transparent material for covering a front surface of the light guide plate and is fixed to the frame, and wherein a gap between the front cover sheet and the frame is finished with waterproofing material so as to keep moisture from invading.

11. The local light-emitting road sign board apparatus of claim 1, wherein the main substrate is provided with an edge bent portion of a shape of ⊏ at an edge portion, wherein the height of the edge bent portion is larger than or substantially equal to the thickness of the locally light-emitting panel.

12. The local light-emitting road sign board apparatus of claim 1, wherein a retroreflective sheet for retroreflecting light shone in the front of the road sign board apparatus is provided in the substrate cover sheet.

13. The local light-emitting road sign board apparatus of claim 1, wherein the locally light-emitting panel comprises:

a light guide plate unit formed by including a light guide plate made of transparent acrylic plate member, a reflective sheet attached to a rear surface of the light guide plate and reflecting light escaping from the light guide plate back into the light guide plate, and a glue attaching the reflective sheet to the light guide plate, wherein at least one of the light guide plate, the reflective sheet, and the glue is provided with a light-scattering element scattering incident light that is provided only at a region corresponding to the road sign portion but the light-scattering element is not provided at another region not corresponding to the road sign portion, so that the incident light through a side surface of the light guide plate is scattered by the light-scattering elements, and light emits only at the region corresponding to the road sign portion;

a light source module disposed closely at a side surface of the light guide plate and inputting light into the light guide plate through the side surface; and a frame forming an outer framework of the locally light-emitting panel by supporting the light source module closely to the side surface of the light guide plate and enclosing all along at least an edge side surface of the light guide plate unit.

14. The local light-emitting road sign board apparatus of claim 13, wherein an edge perimeter of the reflective sheet is attached to the rear surface of the light guide plate without a gap so as to keep moisture from entering through between the reflective sheet and the rear surface of the light guide plate.

15. The local light-emitting road sign board apparatus of claim 13, wherein the locally light-emitting panel further comprises a surface-protecting and/or color-expressing cover sheet for covering a front surface of the light guide plate, and wherein the edge perimeter of the cover sheet and the front surface of the light guide plate are glued sealingly so as to keep moisture from invading therethrough.

16. The local light-emitting road sign board apparatus of claim 1, wherein the locally light-emitting panel further comprises a front surface cover sheet made of transparent material for covering a front surface of the light guide plate and is fixed to the frame, and wherein a gap between the front cover sheet and the frame is finished with waterproofing material so as to keep moisture from invading.

17. The local light-emitting road sign board apparatus of claim 1, wherein the locally light-emitting panel comprises:

a light guide plate, in which a light-scattering element scattering incident light is provided only at a region corresponding to the road sign portion out of the front surface and/or the rear surface of a transparent acrylic plate member but the light-scattering element is not provided at another region not corresponding to the road sign portion, so that the incident light through a side surface of the light guide plate is scattered by the light-scattering elements, and light emits only at the region corresponding to the road sign portion;

a light source module disposed closely at a side surface of the light guide plate and inputting light into the light guide plate through the side surface;

a reflective sheet for covering the rear surface of the light guide plate and reflecting light escaping from the rear surface back into the light guide plate; and a frame forming an outer framework of the locally light-emitting panel by supporting the light source module closely to the side surface of the light guide plate and enclosing edge perimeter portion of the light guide plate and the reflective sheet.

18. The local light-emitting road sign board apparatus of claim 17, wherein an edge perimeter of the reflective sheet is attached to the rear surface of the light guide plate without a gap so as to keep moisture from entering through between the reflective sheet and the rear surface of the light guide plate.

* * * * *